US012607184B2

(12) United States Patent
Lucas et al.

(10) Patent No.: US 12,607,184 B2
(45) Date of Patent: Apr. 21, 2026

(54) STARTING AND STOPPING FRAC PUMPS

(71) Applicant: Halliburton Energy Services, Inc., Houston, TX (US)

(72) Inventors: Bruce Carl Lucas, Duncan, OK (US); Timothy Holiman Hunter, Duncan, OK (US); Mark A. Hudson, Duncan, OK (US); Brad Robert Bull, Duncan, OK (US); Madhur Kohli, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/429,010

(22) Filed: Jan. 31, 2024

(65) Prior Publication Data

US 2025/0243857 A1 Jul. 31, 2025

(51) Int. Cl.
*F04B 49/03* (2006.01)
*E21B 43/26* (2006.01)

(52) U.S. Cl.
CPC ..... *F04B 49/03* (2013.01); *E21B 43/2607* (2020.05)

(58) Field of Classification Search
CPC ..... F04B 49/03; E21B 43/2607
See application file for complete search history.

(56) References Cited

U.S. PATENT DOCUMENTS

| | | | | |
|---|---|---|---|---|
| 4,689,775 | A * | 8/1987 | Scherbatskoy | E21B 47/22 175/48 |
| 11,396,799 | B2 * | 7/2022 | Johnson | E21B 43/2607 |
| 11,808,126 | B2 | 11/2023 | Cook et al. | |
| 11,898,551 | B2 | 2/2024 | He et al. | |
| 2017/0212535 | A1 * | 7/2017 | Shelman | E21B 34/02 |
| 2022/0372858 | A1 | 11/2022 | Scott et al. | |
| 2023/0083234 | A1 | 3/2023 | Cook et al. | |
| 2023/0288010 | A1 | 9/2023 | Johnson et al. | |
| 2023/0332592 | A1 * | 10/2023 | He | F04B 17/06 |

* cited by examiner

*Primary Examiner* — Tara Schimpf
*Assistant Examiner* — Daniel T Craig
(74) *Attorney, Agent, or Firm* — DeLizio, Peacock, Lewin & Guerra LLP

(57) ABSTRACT

Some implementations include a system comprising a first tubular fluidically connected with one or more frac pumps and one or more first flow control devices that are fluidically connected to a second tubular that is fluidically connected to a wellhead. The system also may include a third tubular fluidically connected with the first tubular and one or more second flow control devices that are connected with a fourth tubular that is fluidically independent of the wellhead.

20 Claims, 4 Drawing Sheets

STARTING AND STOPPING FRAC PUMPS

TECHNICAL FIELD

The disclosure generally relates to the field of pumps. More specifically, some implementations relate to hydraulic fracturing pumps ("frac pumps").

BACKGROUND

Some hydrocarbon production environments utilize frac pumps to facilitate hydraulic fracturing operations. Some frac pumps include electric motors. During operation, the frac pumps may be exposed to high pressure. Under high pressure, the electric motors may have difficulty starting-up or shutting down.

BRIEF DESCRIPTION OF THE DRAWINGS

Aspects of the disclosure may be better understood by referencing the accompanying drawings.

DESCRIPTION

The description that follows includes example systems, methods, techniques, and operational flows that embody aspects of the disclosure. However, this disclosure may be practiced without these specific details. For clarity, some well-known structures and techniques have been omitted.

Overview

A hydraulic fracturing pump ("frac pump") may include an electric motor that moves a pumping device. At low speeds (such as at starts-up), the electric motor may not have enough torque to overcome forces resisting movement of the electric motor. For example, at start-up, high pressure fluid exerting pressure on the pumping device may resist the electric motor. That is, high pressure fluid may inhibit the electric motor from actuating the pumping device. Some implementations reduce or eliminate resistive forces by routing fluids in a manner that reduces or eliminates pressure on the pumping device.

Some implementations reduce or eliminate pressure during startup of the electric motor. Before startup, some implementations open a discharge to eliminate pressure on the pumping device. Because there is little or no pressure to resist the electric motor, some implementations can efficiently spin-up the electric motor to an operating speed at which the electric motor can produce enough torque to overcome resistive forces that may arise from operating pressures. After reaching operating speed, some implementations may close the discharge and allow pressure to increase to an operating pressure range.

In some implementations, some configurations may enable a multi-pump system to shut down a single frac pump for maintenance without shutting down other frac pumps. These configurations may isolate fluid flows of the single frac pump from the other frac pumps. After isolating the fluid flow, some configurations may reduce resistive forces (such as those caused by fluid pressure) on the single frac pump's electric motor by routing fluids through a discharge or other flow path. After reducing resistive forces on the electric motor, the electric motor may reduce speed and shutdown. After shutdown, operators may perform maintenance on the frac pump without shutting down other the frac pumps. Additionally, some implementations may avoid damage to frac pumps by reducing the pressure in the frac pump before stopping the pump. By reducing pressure, residual torque in the drive line is released in normal forward direction, thus not causing the driveline to spin the frac pump backwards suddenly at stop, and preventing potential damage to components of the driveline and pump gearboxes.

The configurations, components, and flow paths described herein also may maintain ideal electric motor speeds at higher pressures and lower rates. This may be useful for pressure testing or applications where refined rate control is desired.

Example Environment

Figure 1:
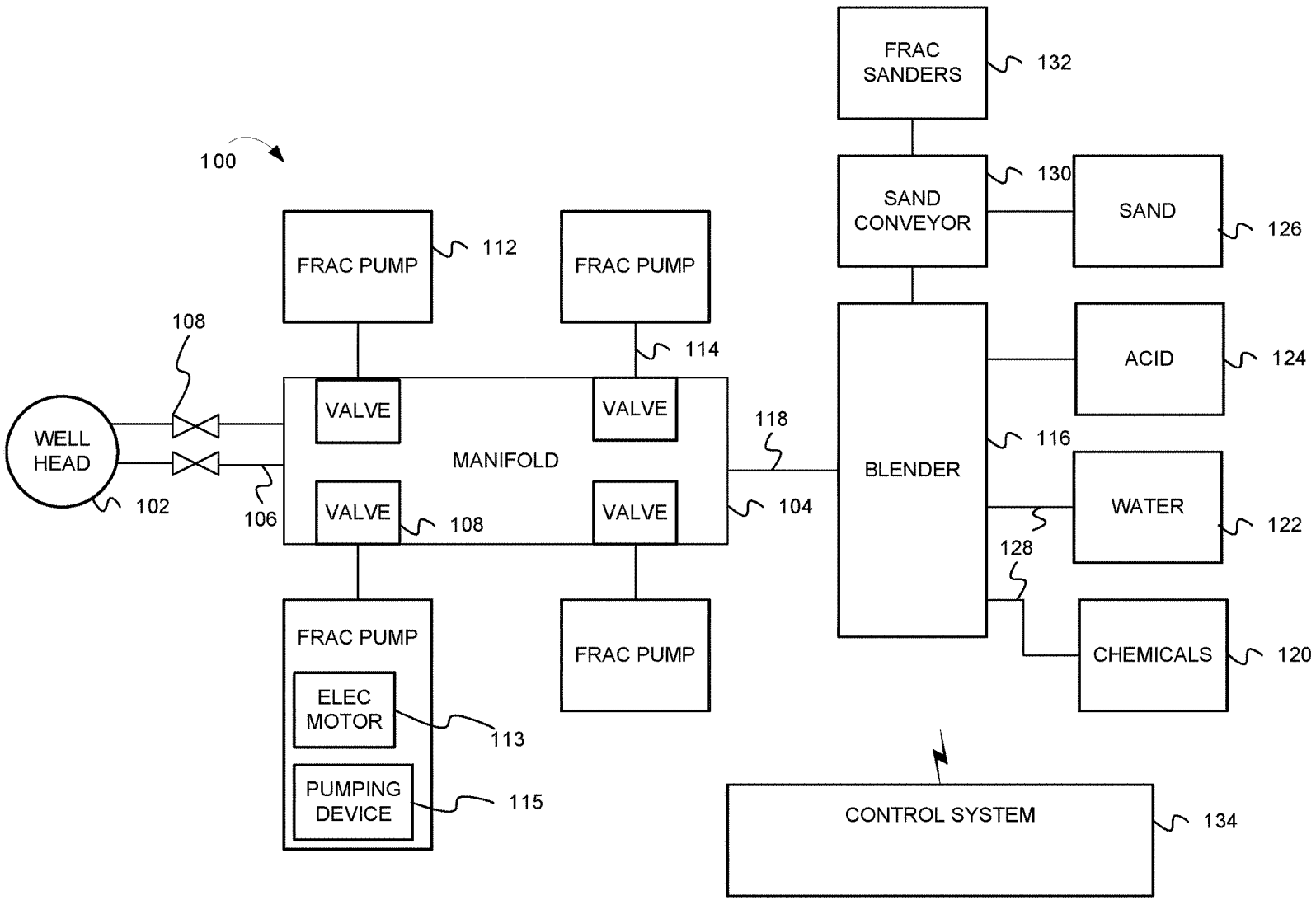
FIG. 1 is a block diagram illustrating a system for hydraulically fracturing subsurface formations in one or more wells.

The frac pumps, flow loops, components, and configurations described herein may be part of a larger system for performing operations for hydraulic fracturing. FIG. 1 is a block diagram illustrating a system for hydraulically fracturing subsurface formations in one or more wells. The system 100 may include a wellhead 102 that is connected to a wellbore. The wellbore (not shown) may be fluidically connected to one or more subsurface formations for the purpose of hydrocarbon recovery. Although FIG. 1 shows only one wellhead 102, there may be any suitable number of wellheads 102 and wells.

The wellhead 102 may be connected to a manifold 104 via piping 106. The piping 106 may include one or more tubulars between the wellhead 102 and the manifold 104. The manifold 104 may include a plurality of valves 108 and various internal piping (not shown) for performing hydraulic fracturing operations. Any of the valves and components described herein may include or otherwise be coupled with one or more sensors of any suitable type.

The manifold 104 may be connected to one or more frac pumps 112. The frac pumps 112 may include one or more electric motors 113 and one or more pumping devices 115. The frac pumps 112 may include any of the flow paths, components, and/or configurations described herein. In some implementations, the frac pumps 112 relieve pressure to better enable their electric motors to reach operating torque. In some implementations, a single frac pump 112 may be shut down (such as for maintenance) without affecting any frac pumps 112. Operations, components, and configurations involving the frac pumps 112 are described herein in further detail (for example see description of FIGS. 2-4).

The frac pumps 112 may inject fracturing fluid into the wellbore under specified pressures and at predetermined flow rates. Each pump may be indicative of a single, discrete pumping device, but could alternatively comprise multiple pumps included on or forming part of a pump truck or other pumping platform. All of the frac pumps 112 may or may not be the same type, size, configuration, or from the same manufacturer. Rather, some or all of the frac pumps 112 may be unique in size, output capability, etc.

The manifold 104 also may be connected to a blender 116 via piping 118. The blender 116 may be connected via piping 128 to one or more chemical containers 120, water containers 122, and acid containers 124. The blender 116 also may be connected to a sand conveyor 130, where the sand conveyor 130 may be connected to the container of fracturing sanders 132.

The system 100 also may contain a control system 134 configured to control one or more of the components of the system 100. In some implementations, the control system 134 directly controls the equipment in operations for hydraulic fracturing. However, the control system 134 may interact with various equipment controllers (not shown) and sensors to perform operations related to hydraulic fracturing.

Example Components, Flow Paths, Configurations, and Operations

Figure 2:
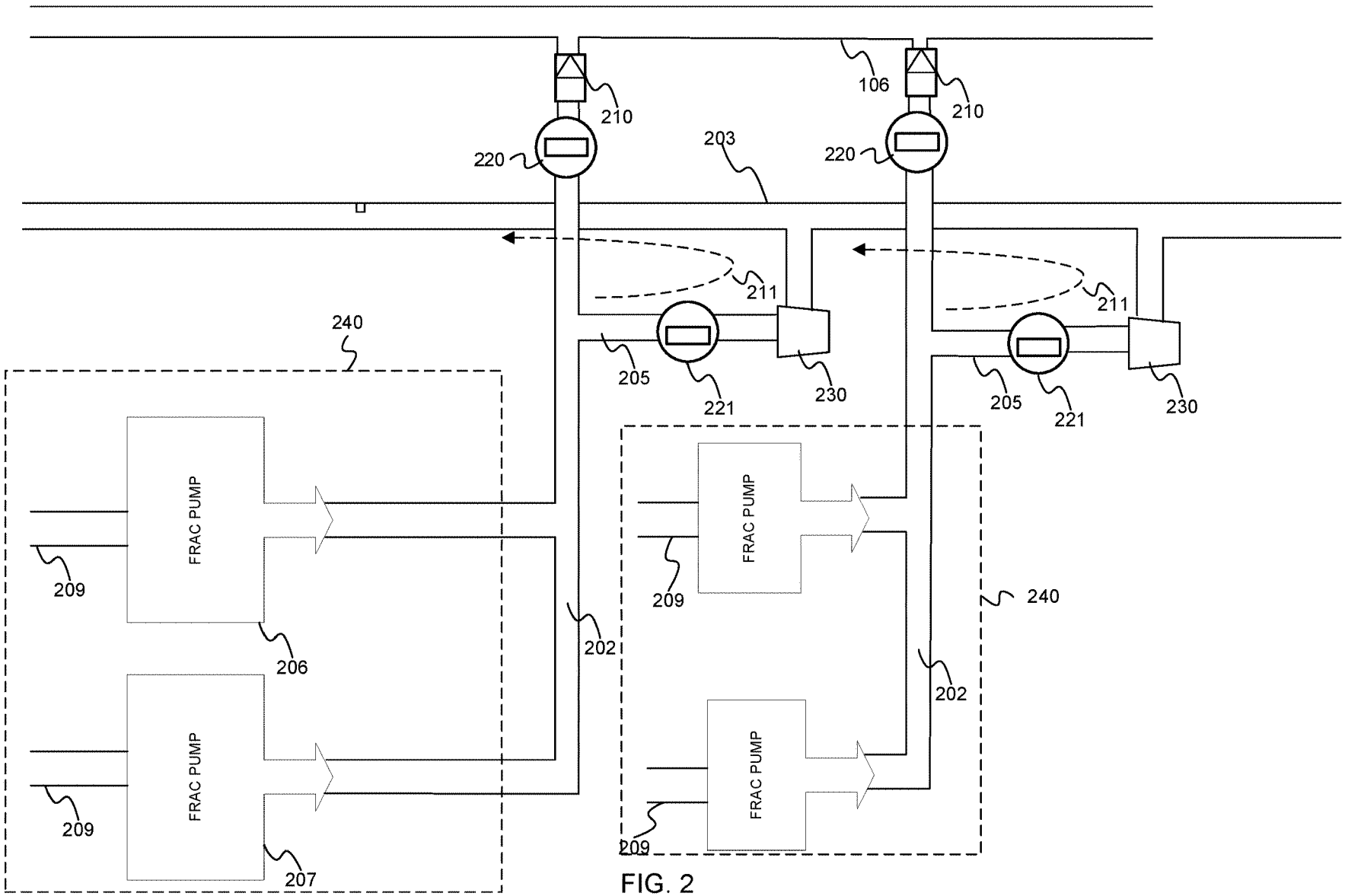
FIG. 2 is a block diagram illustrating a configuration for operating a frac pump.

FIG. 2 is a block diagram illustrating a configuration for operating a frac pump. In FIG. 2, the configuration 200 may include one or more pumping stations 240.

Each of the pumping stations may include frac pumps 206 and 207. A non-positive displacement pump (not shown in FIG. 2) may deliver fluid (such as hydraulic fracturing fluid) to the frac pumps 206 and 207 through tubulars 209 at an inlet pressure (such as a pressure ranging from 30 to 120 PSI) and inlet rate (such as a rate ranging from 0 to 30 BPM). The non-positive displacement pump may add rate and pressure to the fluid to maintain substantially the same flow rate as the frac pump. The frac pumps 206 and 207 may output the fluid to a discharge manifold (such as manifold 104 of FIG. 1) which may be fluidically connected to an isolation valve 220, tubular 205, and flow control valve 221.

The frac pumps 206 and 207 each may include an electric motor and pumping device. The frac pumps 206 and 207 may be fluidically connected to a tubular 202 that may be fluidically connected to a flow path that includes another tubular 205. The tubular 205 may be fluidically connected to a flow control valve 221 that may be fluidically connected to a choke 230 (such as a high pressure choke). The choke 230 may be fluidically connected to another tubular 203 that may be connected to the blender 116 (or other component of the system 100—see FIG. 1). The choke 230 may be adjusted to modify flow and pressure such as to create back pressure on the frac pumps 206 and 207, or may be a fixed orifice such that flow rate through the choke is able to create back pressure on the frac pumps.

The tubular 202 also may be fluidically connected to an isolation valve 220 that may be fluidically connected to a check valve 210. The check valve 210 may be fluidically connected to the wellhead 102 (see FIG. 1) via a tubular 106.

Each pumping station 240 may include the components described herein for connecting one or more frac pumps to the tubular 106. The configurations and operations described herein enable each pumping station 240 to be independently shut down for maintenance (or other offline operations) (without shutting down any other pumping station). Although the configuration 200 includes the valves 220 and 221 and the choke 230, the configuration 200 may substitute any of these devices for any other suitable flow control device.

Before the configuration 200 becomes operational, the frac pumps 206 and 207 may be exposed to little or no pressure. Before operation of the frac pumps 206 and 207, the isolation valve 220 may be closed and the tubular 203 may be at atmospheric pressure. The flow control valve 221 may be open or closed. Before starting the frac pumps 206 and 207, the flow control valve 221 may be opened and the choke 230 may be opened (if it is an adjustable choke). Pressure in the tubular 205 may be zero when the choke 230 is open and there is no flow through the choke 230. The frac pumps 206 and 207 may begin pumping fluid into the tubular 202 and through the flow control valve 221 and choke 230 into the tubular 203. This flow path is shown as flow loop 211.

As the frac pumps 206 and 207 increase their rate, flow through the choke 230 may produce resistance to flow and cause the pressure in the flow loop 211 to increase. When the pressure in the flow loop 211 exceeds the pressure in the well (such as 5000 psi), if the isolation valve 220 is opened, fluid may flow through the check valve 210 into the tubular 106. The flow control valve 221 or actuator for the choke 230 may be closed to direct all flow from the frac pumps 206 and 207 to the well, or inversely, opened to allow all flow from the parallel flow loop out through the choke 230. The fluid that passes through the choke 230 may be returned to the inlet side of the pump, to a frac fluid supply vessel, pump or blender 116 up stream of the frac pumps, or to a waste tank.

After the frac pumps 206 and 207 are spinning at a rate that can overcome resistive forces that may arise during hydraulic fracturing operations (such as when the electric motors can produce substantially constant torque), the isolation valve 220 may be opened and fluid may flow through the check valve 210 into the tubular 106 (if pressure in the flow loop 211 exceeds pressure in the tubular 106). The choke 230 may then be closed to prevent fluid from flowing from the tubular 202 into the tubular 203. At this point, the frac pumps 206 and 207 may be pumping fluid into the well.

The configuration 200 may reduce pressure on the frac pumps 206 and 207 as part of a shutdown process. As the frac pumps 206 and 207 are running, fluid may be flowing though the tubular 202 and through the isolation valve 220 and check valve into the tubular 106. There may be no fluid flowing through the flow control valve 221 because it is closed. The frac pumps 206 and 207 may slow down to a stop. After the frac pumps 206 and 207 have stopped, the isolation valve 220 may be closed (thereby maintaining pressure in the well) and the flow control valve 221 may be opened to cause fluid to flow through the choke 230 into the tubular 203. The degree to which the flow control valve 221 and choke 230 allow fluid to flow into the tubular 203 may depend on fluid volumes and pressures needed to maintain control over pressure at the wellhead 102. After pressure has been released, operators can perform maintenance on the frac pumps 206 and 207. To restart the frac pumps 206 and 207, the start-up operations described herein may be performed.

Some implementations may perform the following operations to start pumping: 1) Open the valves 220 and 221. 2) Verify the check valve 210) is holding. 3) Open the choke/actuator 230. 4) Ramp the pump rate with clean flow through the tubular 203. 5) Increase pump flow rate or close choke 230 (if choke 230 is a variable choke) to build pressure.

Some implementations may perform the following operations to stop pumping: 1) Slow the frac pumps 206 and 207 to a slow pump rate. 2) Open the isolation valve 221 3) Open the choke 230 to reduce pressure. 4) Verify that the check valve 210 is holding. 5) Close the isolation valve 220. 6) Disable the frac pumps 206 and 207 at low pressure. In some situations, these operations may avoid damage to frac pumps by reducing the pressure in the frac pump before stopping the pump. By reducing pressure, residual torque in the drive line is released in normal forward direction, thus not causing the driveline to spin the frac pump backwards suddenly at stop and preventing potential damage to components of the driveline and pump gearboxes.

Figure 3:
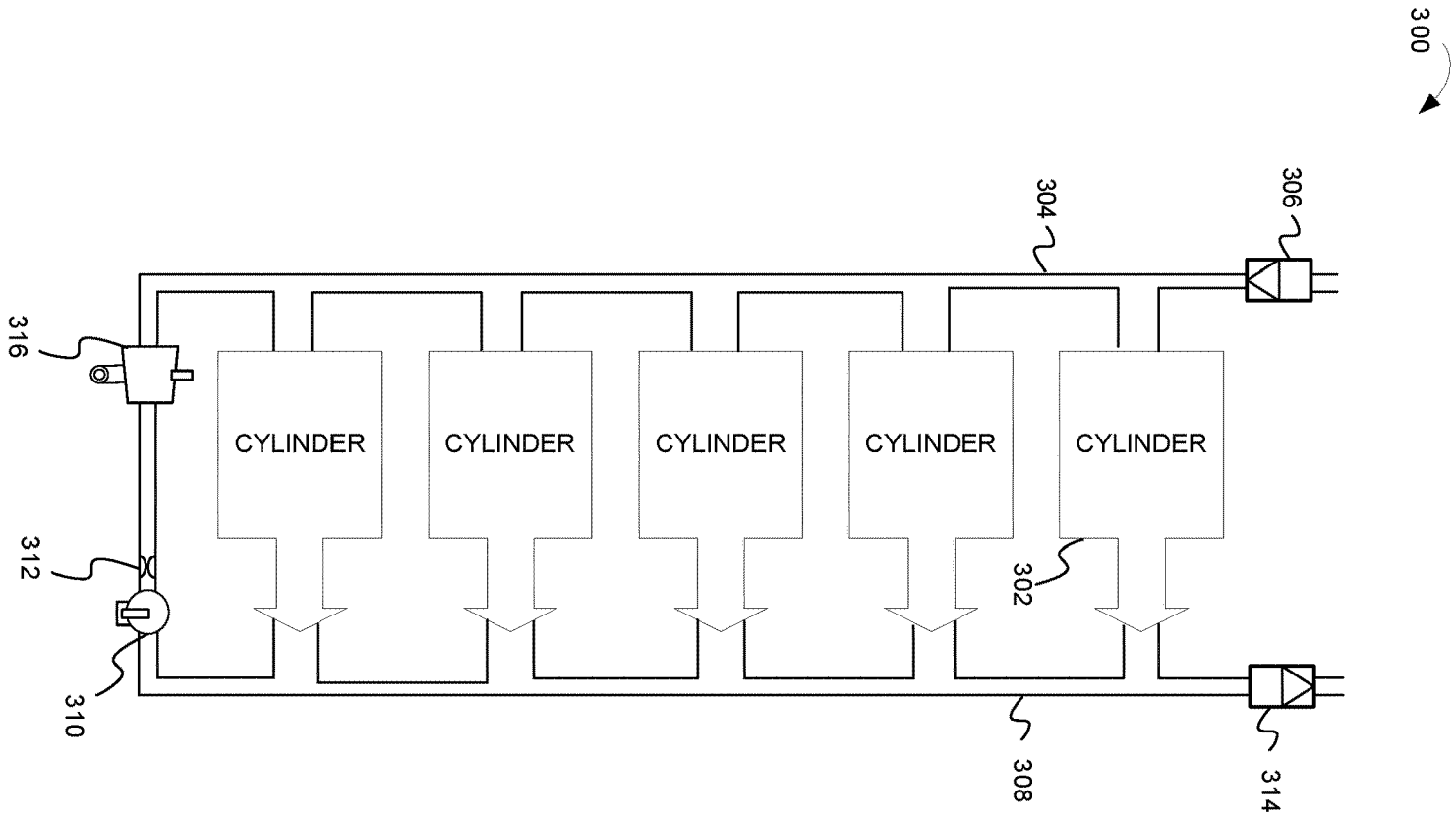
FIG. 3 is a block diagram illustrating a frac pump.

FIG. 3 is diagram illustrating a frac pump. The frac pump 300 may be included in the system 100 along with a plurality of other frac pumps. The frac pump 300 may include one or more cylinders 302 or other pumping devices configured for pumping fluid. The frac pump 300 also may include an electric motor. The frac pump 300 can be configured to reduce or eliminate pressure during startup and shutdown.

For startup, fluid may enter a tubular 304 through a check valve 306. Each cylinder 302 may take in fluid from the tubular 304 and discharge the fluid into the tubular 308. To reduce or eliminate force (such as back pressure) on the cylinders 302 during startup, the frac pump 300 may route fluid from the tubular 308 back into the tubular 304. To route fluid from the tubular 308 back into the tubular 304, a flow control valve 310 may be opened and a choke 312 may be opened. As the cylinders 302 begin pumping fluid, fluid discharged from the cylinders 302 may flow through the flow control valve 310 and the choke 312 into the tubular 304. The choke 312 may be adjusted to increase pressure on the cylinders 302. The frac pump 300 may continue circulating the fluid from the tubular 308 to the tubular 304 until the frac pump's electric motors (or other drive device) are operating at a rate that can overcome forces that may arise from higher pressures (such as during hydraulic fracturing operations). In some implementations, this may occur when the frac pump's electric motors can produce constant torque. After the frac pump has achieved the desired level of operation, fluid flow may be routed to the tubular 106 by closing the flow control valve 310. After the flow control valve 310 is closed, fluid may flow through the check valve 314 into the tubular 106.

For shutdown, the flow control valve 310 and the choke 312 may be opened to circulate fluid from the tubular 308 to the tubular 304. As the frac pump 300 shuts down, pressure reduces on the cylinders 302. A pressure relief device 316 may be opened to eliminate any residual pressure or limit maximum pressure on the low pressure manifold. After shutdown, operators may perform maintenance or other operations on the frac pump 300.

Although the frac pump 300 includes check valves 306 and 314, flow control valve 310, and choke 312, the frac pump 300 may include any suitable flow control devices to achieve the operations and functionality described herein. The frac pump 300 also may include a suction input that may be atmospheric air, compressed air, clean fluid, dirty fluid, or some other liquid or gas for treating the well, displacing other fluids, cleaning, drying, protecting the pump, piping or well from corrosion, freezing, chemical buildup, etc.

Figure 4:
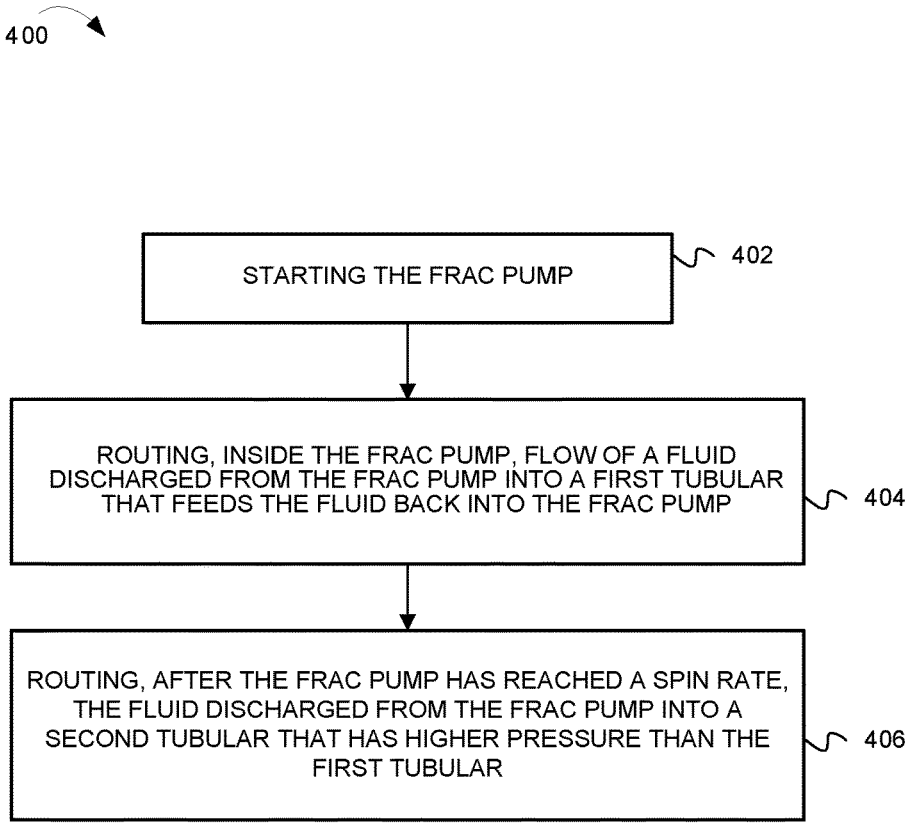
FIG. 4 is a flow diagram illustrating operations for operating a frac pump.

FIG. 4 is a flow diagram illustrating operations for operating a frac pump. In FIG. 4, the flow 400 begins at block 402. At block 402, the frac pump starts. That is, the frac pump begins pumping. At block 404, (inside the frac pump) flow of a fluid discharged from the frac pump is routed back into a first tubular that feeds the fluid back into the frac pump. At block 406, after the frac pump has reached a spin rate, rout the fluid discharged from the frac pump into a second tubular that has higher pressure than the first tubular.

In some implementations, the flow control devices described herein may be operated via external force (such as by human operators actuating or setting the flow control devices) or automated operation. Some automated flow control devices may cooperate with one or more electronic control devices configured to facilitate the operations described herein. Some implementations may utilize machine-readable instructions (such as computer-readable instructions) stored on a tangible machine-readable medium (such as a magnetic medium).

As used herein, the term "or" is inclusive unless otherwise explicitly noted. Thus, the phrase "at least one of A, B, or C" is satisfied by any element from the set {A, B, C} or any combination thereof, including multiples of any element.

Some implementations may aspects as described in the following clauses.

Clause 1: A system comprising: a first tubular fluidically connected with one or more frac pumps and one or more first flow control devices that are fluidically connected to a second tubular that is fluidically connected to a wellhead; and a third tubular fluidically connected with the first tubular and one or more second flow control devices that are connected with a fourth tubular that is fluidically independent of the wellhead.

Clause 2: The system of clause 1, wherein at least one of the first flow control devices is configured to be closed upon start-up of the frac pumps, and wherein the second flow control devices are configured to be open upon start-up of the frac pumps to reduce pressure on the frac pumps.

Clause 3: The system of any one or more of clauses 1-2 further configured to, upon start-up, have first pressure in the second tubular that is greater than second pressure in first tubular.

Clause 4: The system of any one or more of clauses 1-3, wherein at least one of the first flow control devices is configured to be closed upon shutdown of the frac pumps, and wherein the second flow control devices are configured to be open upon start-up of the frac pumps to reduce pressure on the frac pumps.

Clause 5: The system of any one or more of clauses 1-4 further configured to, upon shutdown, have first pressure in the fourth tubular that is less than second pressure in first tubular.

Clause 6: The system of any one or more of clauses 1-5, wherein the third tubular is fluidically connected to the first tubular between the frac pumps and the one or more first flow control devices.

Clause 7: The system of any one or more of clauses 1-6, wherein the first flow control devices include one or more of a check valve, ball valve, gate valve, butterfly valve, and globe valve.

Clause 8: The system of any one or more of clauses 1-7, wherein the second flow control devices include one or more of a choke, check valve, ball valve, gate valve, butterfly valve, and globe valve.

Clause 9: A pump comprising: an intake tubular fluidically connected to a discharge tubular configured to be fluidically connected to a third tubular; one or more cylinders configured to fluidically intake fluid via the intake tubular and discharge fluid via the discharge tubular and on to the third tubular; one or more first flow control devices fluidically connected to the intake tubular and the discharge tubular, the first flow control devices configured to enable, upon start-up of the pump, fluid discharged into the discharge tubular to flow into the intake tubular, and restrict, upon shutdown of the pump, fluid flow between the discharge tubular and the intake tubular.

Clause 10: The pump of clause 9 further comprising: a second flow control device fluidically connected to the discharge tubular and a third tubular.

Clause 11: The pump of any one or more of clauses 9-10, wherein a first pressure in the third tubular is higher than a second pressure in the discharge tubular.

Clause 12: The pump of any one or more of clauses 9-11 further including a pressure relieve device fluidically connected to the intake tubular.

Clause 13: The pump of any one or more of clauses 9-12, wherein the intake tubular is connected to a third flow control device that is connected to a fourth tubular.

Clause 14: The pump of any one or more of clauses 9-13, wherein the first flow control devices include a choke and a valve.

Clause 15: A method comprising: starting a frac pump; routing, inside the frac pump, flow of a fluid discharged from the frac pump into a first tubular that feeds the fluid back into the frac pump; and routing, after the frac pump has reached a spin rate, the fluid discharged from the frac pump into a second tubular that has higher pressure than the first tubular.

Clause 16: The method of clause 15 further comprising: pumping the fluid into the second tubular; routing, after the pumping, flow of the fluid discharged from the frac pump into the first tubular that feeds the fluid into the frac pump; and shutting down the frac pump.

Clause 17: The method of any one or more of clauses 15-16, wherein the fluid discharged from the frac pump flows into a third tubular connected a flow control device that is connected to the first tubular.

Clause 18: The method of any one or more of clauses 15-17, wherein the flow control device includes a choke.

Clause 19: The method of any one or more of clauses 15-18, wherein the frac pump includes a plurality of cylinders each connected to the first tubular.

Clause 20: The method of any one or more of clauses 15-19, wherein each of the cylinders includes a respective intake that is fluidically connected to the first tubular.

What is claimed is:

1. A system comprising:

a first tubular fluidically connected with one or more frac pumps and one or more first flow control devices that are fluidically connected to a second tubular that is fluidically connected to a wellhead, wherein the first tubular and the second tubular define a first flow path for transporting fluid to the wellhead; and a third tubular fluidically connected with the first tubular and one or more second flow control devices that are fluidically connected with a fourth tubular, wherein the third tubular and the fourth tubular define a second flow path for transporting fluid to a location other than the wellhead and wherein the one or more second flow control devices comprise a valve and a choke, wherein the choke is an adjustable choke and is configured based, at least in part, on an amount of pressure in the second tubular.

2. The system of claim 1, wherein the third tubular is fluidically connected to the first tubular between the frac pumps and the one or more first flow control devices.

3. The system of claim 1, wherein the first flow control devices include one or more of a check valve, ball valve, gate valve, butterfly valve, plug valve, and globe valve.

4. The system of claim 1, wherein, during a start-up process for the frac pumps, at least one of the first flow control devices is configured to be closed and the second flow control devices are configured to be open, wherein the choke is configured to produce fluid pressure in the first tubular that exceeds fluid pressure in the second tubular during well operations.

5. The system of claim 4, wherein, during an operational process for the frac pumps, the first flow control devices are configured to be open and at least one of the second flow control devices are configured to be closed.

6. The system of claim 1, wherein, during a shutdown process for the frac pumps, at least one of the first flow control devices is configured to be closed and the second flow control devices are configured to be open, wherein the second flow control devices being open causes fluid pressure in the first tubular to decrease.

7. The system of claim 6, wherein, during an operational process for the frac pumps, the first flow control devices are configured to be open and at least one of the second flow control devices are configured to be closed.

8. A method comprising:

starting a frac pump;

routing, inside the frac pump, flow of a fluid discharged from the frac pump into a first tubular that feeds the fluid back into the frac pump;

routing, after the frac pump has reached an operating condition, the fluid discharged from the frac pump into a second tubular that has higher pressure than the first tubular;

pumping the fluid into the second tubular;

routing, after the pumping, flow of the fluid discharged from the frac pump into the first tubular that feeds the fluid into the frac pump;

shutting down the frac pump; and releasing, while shutting down the frac pump or subsequent to shutting down the frac pump, pressure from the first tubular via a pressure relief valve.

9. The method of claim 8, wherein the fluid discharged from the frac pump flows into a third tubular connected a flow control device that is connected to the first tubular.

10. The method of claim 9, wherein the flow control device includes a choke.

11. The method of claim 8, wherein the frac pump includes a plurality of cylinders each connected to the first tubular.

12. The method of claim 11, wherein each of the cylinders includes a respective intake that is fluidically connected to the first tubular.

13. A system comprising:

a first tubular fluidically connected with one or more frac pumps and one or more first flow control devices that are fluidically connected to a second tubular that is fluidically connected to a wellhead, wherein the first tubular and the second tubular define a first flow path for transporting fluid to the wellhead; and a third tubular fluidically connected with the first tubular and one or more second flow control devices that are fluidically connected with a fourth tubular, wherein the third tubular and the fourth tubular define a second flow path for transporting fluid to a location other than the wellhead and wherein the one or more second flow control devices comprise a valve and a choke, wherein during a start-up process for the frac pumps, at least one of the first flow control devices is configured to be closed and the second flow control devices are configured to be open, wherein the choke is configured to produce fluid pressure in the first tubular that exceeds fluid pressure in the second tubular during well operations.

14. The system of claim 13, wherein, during an operational process for the frac pumps, the first flow control devices are configured to be open and at least one of the second flow control devices are configured to be closed.

15. The system of claim 13, wherein, during a shutdown process for the frac pumps, at least one of the first flow control devices is configured to be closed and the second flow control devices are configured to be open, wherein the second flow control devices being open causes fluid pressure in the first tubular to decrease.

16. The system of claim 13, wherein the choke is an adjustable choke and is configured based, at least in part, on an amount of pressure in the second tubular.

17. A system comprising:

a first tubular fluidically connected with one or more frac pumps and one or more first flow control devices that are fluidically connected to a second tubular that is fluidically connected to a wellhead, wherein the first tubular and the second tubular define a first flow path for transporting fluid to the wellhead; and a third tubular fluidically connected with the first tubular and one or more second flow control devices that are fluidically connected with a fourth tubular, wherein the third tubular and the fourth tubular define a second flow path for transporting fluid to a location other than the wellhead and wherein the one or more second flow control devices comprise a valve and a choke, wherein, during a shutdown process for the frac pumps, at least one of the first flow control devices is configured to be closed and the second flow control devices are configured to be open, wherein the second flow control devices being open causes fluid pressure in the first tubular to decrease.

18. The system of claim 17, wherein, during a start-up process for the frac pumps, at least one of the first flow control devices is configured to be closed and the second flow control devices are configured to be open, wherein the choke is configured to produce fluid pressure in the first tubular that exceeds fluid pressure in the second tubular during well operations.

19. The system of claim 17, wherein, during an operational process for the frac pumps, the first flow control devices are configured to be open and at least one of the second flow control devices are configured to be closed.

20. The system of claim 17, wherein the choke is an adjustable choke and is configured based, at least in part, on an amount of pressure in the second tubular.

* * * * *